US009327204B2

(12) United States Patent
Chen

(10) Patent No.: US 9,327,204 B2
(45) Date of Patent: May 3, 2016

(54) REMOTE CONTROLLED AND RECHARGEABLE TOY HELICOPTER

(71) Applicant: Bo Chen, Shantou (CN)

(72) Inventor: Bo Chen, Shantou (CN)

( * ) Notice: Subject to any disclaimer, the term of this patent is extended or adjusted under 35 U.S.C. 154(b) by 0 days.

(21) Appl. No.: 14/270,338

(22) Filed: May 5, 2014

(65) Prior Publication Data

US 2015/0314207 A1 Nov. 5, 2015

(51) Int. Cl.
*A63H 27/127* (2006.01)
*A63H 27/00* (2006.01)
*A63H 30/04* (2006.01)

(52) U.S. Cl.
CPC ..... *A63H 27/12* (2013.01); *A63H 30/04* (2013.01); *Y10T 29/49828* (2015.01)

(58) Field of Classification Search
CPC ..... A63H 30/04; A63H 33/00; A63H 27/12; A63H 27/92; A63H 17/002; A63H 17/008; H02J 7/0044
See application file for complete search history.

(56) References Cited

U.S. PATENT DOCUMENTS

| | | | | |
|---|---|---|---|---|
| 5,334,076 | A * | 8/1994 | Shinozuka | 446/456 |
| 5,836,545 | A * | 11/1998 | Arlton et al. | 244/60 |
| 6,036,574 | A * | 3/2000 | Halford | 446/429 |
| 6,913,507 | B2 * | 7/2005 | Hui | 446/429 |
| 7,168,657 | B2 * | 1/2007 | Chen | 244/108 |
| 8,083,568 | B2 * | 12/2011 | Reiss | 446/429 |
| 8,337,274 | B1 * | 12/2012 | Wong | 446/454 |
| 8,574,021 | B2 * | 11/2013 | Mayer et al. | 446/433 |
| 2002/0106966 | A1 * | 8/2002 | Jimenez et al. | 446/454 |
| 2002/0132556 | A1 * | 9/2002 | So | 446/456 |
| 2003/0040247 | A1 * | 2/2003 | Rehkemper et al. | 446/34 |
| 2005/0003734 | A1 * | 1/2005 | Lam et al. | 446/456 |
| 2005/0003735 | A1 * | 1/2005 | Carter et al. | 446/456 |
| 2005/0176345 | A1 * | 8/2005 | Harrelson et al. | 446/456 |
| 2006/0113428 | A1 * | 6/2006 | Choi | 244/190 |
| 2006/0135035 | A1 * | 6/2006 | Leung | 446/456 |
| 2006/0231677 | A1 * | 10/2006 | Zimet et al. | 244/17.23 |
| 2009/0008497 | A1 * | 1/2009 | Corsiglia et al. | 244/17.11 |
| 2009/0170395 | A1 * | 7/2009 | Wai | 446/38 |
| 2010/0144234 | A1 * | 6/2010 | Wai et al. | 446/75 |
| 2012/0126956 | A1 | 5/2012 | Trzecieski et al. | |
| 2012/0187238 | A1 * | 7/2012 | Lam | 244/17.21 |
| 2014/0091942 | A1 * | 4/2014 | Matloff et al. | 340/815.53 |

FOREIGN PATENT DOCUMENTS

| | | | |
|---|---|---|---|
| CN | 201482197 | U | 5/2010 |

* cited by examiner

*Primary Examiner* — Michael Dennis
*Assistant Examiner* — Urszula M Cegielnik
(74) *Attorney, Agent, or Firm* — Minder Law Group; Willy H. Wong

(57) ABSTRACT

A remote control helicopter includes a body, a tail wing, a rotor assembly, a landing skid assembly, and a charging port on the bottom of the helicopter. The remote control for the helicopter includes an outer housing, landing skid grooves, a power switch, a throttle control stick that controls the ascent and the descent, a direction control stick that controls the turning or rotation of the helicopter, and a charging plug.

9 Claims, 9 Drawing Sheets

REMOTE CONTROLLED AND RECHARGEABLE TOY HELICOPTER

FIELD OF INVENTION

The present invention relates to toys, more specifically to a remote controlled and rechargeable flying toy helicopter.

BACKGROUND OF INVENTION

Remote control (RC) helicopters are popular electronic toys in the mass market. However, RC helicopters can take up a large amount of shelf space and are difficult to assemble and disassemble.

A significant portion of that shelf space is used to protect the rotors and rotor blades, which can be damaged or broken if an RC helicopter is not appropriately packaged and stored. The rotors and rotor blades of prior art RC helicopters are typically secured onto the RC helicopter using screws. These prior art rotors and rotor blades are designed to prevent detachment of the rotors and rotor blades from the RC helicopter, making disassembly of the rotors and rotor blades difficult. Accordingly, the prior art RC helicopters must take a large amount of shelf space.

Most RC helicopters also require recharging such as via a USB port with a USB adaptable charging cable, via a power cable attached to a charger attached to a wall, or via a recharging cable attached to the 2 in 1 charger and remote control. For RC helicopters, the latter recharging method is generally preferred as it requires no external or additional power source, such as a USB port or a wall outlet. In a typical RC helicopter using the latter recharging method, there is a rechargeable battery located inside the RC helicopter. This rechargeable battery is recharged from the remote control by plugging the RC helicopter into the remote control using the recharging cable or wire. The remote control itself is typically powered by a plurality of alkaline batteries enclosed within the remote control. Once the RC helicopter is recharged, the cable is unplugged and the RC helicopter can be played with using the remote control.

The connection pieces for these prior art cables and connectors are difficult for younger children to distinguish and these younger children may misconnect or even break the connection pieces while attempting to recharge the RC helicopter. The above prior art recharging solutions do not easily prevent this issue of misconnecting the RC helicopter to a charging source, such as a USB port or the remote control. In addition, the remote controls of prior art RC helicopters can also take up a large amount of shelf space.

SUMMARY OF THE INVENTION

It is an object of the invention to overcome the disadvantages of the prior art discussed above.

It is an object of the invention to minimize the amount of shelf space and storage space taken by an RC helicopter and its remote control.

It is an object of the invention to provide a sturdy platform to secure an RC helicopter.

It is an object of the invention to make it easier and more straightforward to attach an RC helicopter to its remote control.

It is an object of the invention to prevent breakage of an RC helicopter and its remote control.

It is an object of the invention to provide easy assembly and disassembly of an RC helicopter.

It is an object of the invention to simplify and reduce costs of the manufacture and the assembly of an RC helicopter.

It is an object of the invention to provide a child friendly RC helicopter.

It is another object of the invention to provide a simple, efficient, durable, and cost effective RC helicopter.

To address the aforementioned objectives and other objectives that will become apparent from the description of the invention, the present invention provides a rechargeable RC helicopter with a remote control. The remote control contains grooves capable of attaching to the landing skids of the RC helicopter. When in the attached position, the remote control and RC helicopter are also connected at the recharging plug and port, thereby charging the RC helicopter. Various portions of the RC helicopter can be assembled and disassembled without the use of additional fasteners and tools.

DETAILED DESCRIPTION OF THE INVENTION

Figure 1:
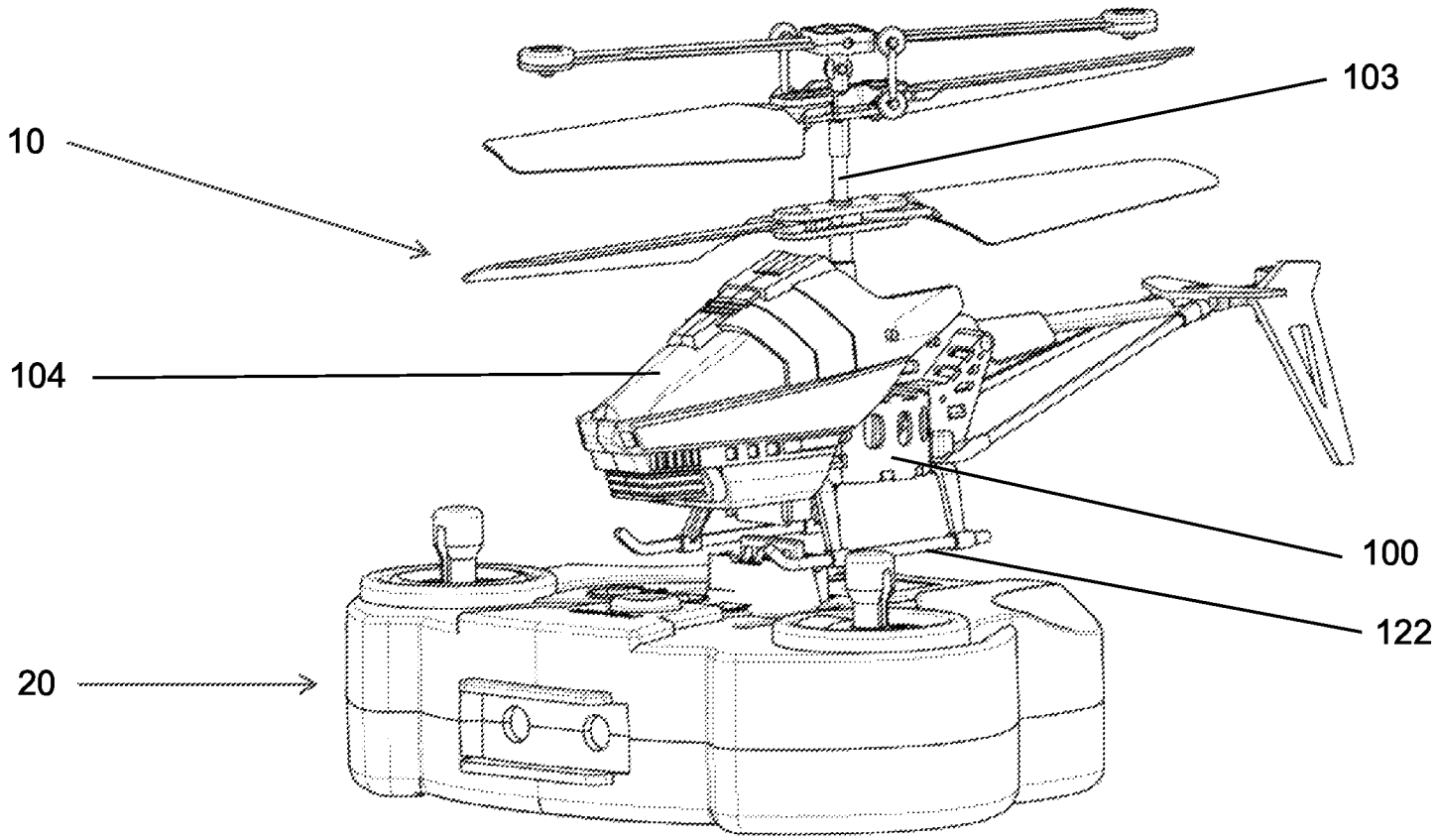
FIG. 1 illustrates a perspective view of an RC helicopter and a remote control in accordance with an embodiment of the present invention.
Figure 2:
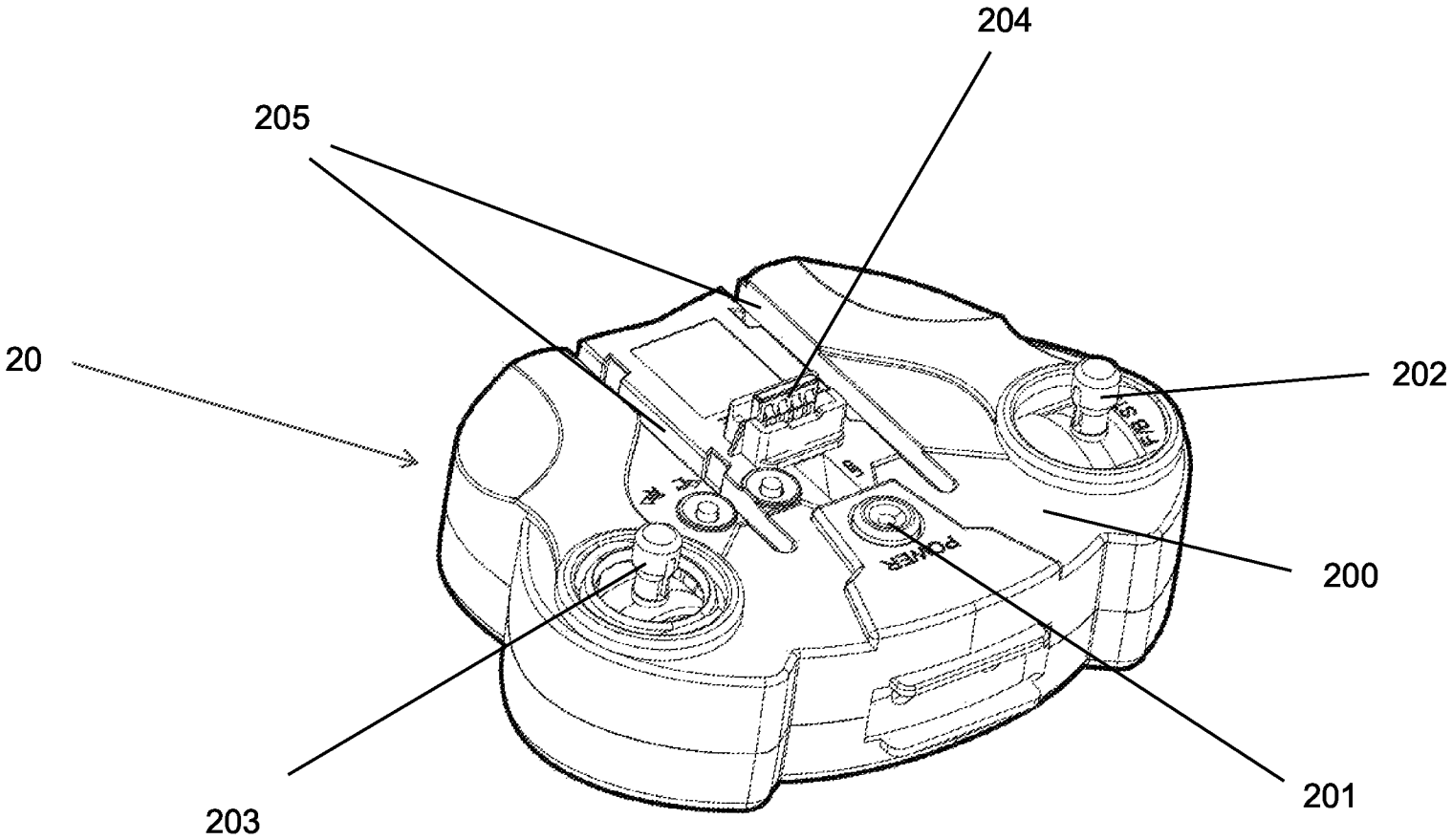
FIG. 2 illustrates a perspective view of a remote control in accordance with an embodiment of the present invention.
Figure 3:
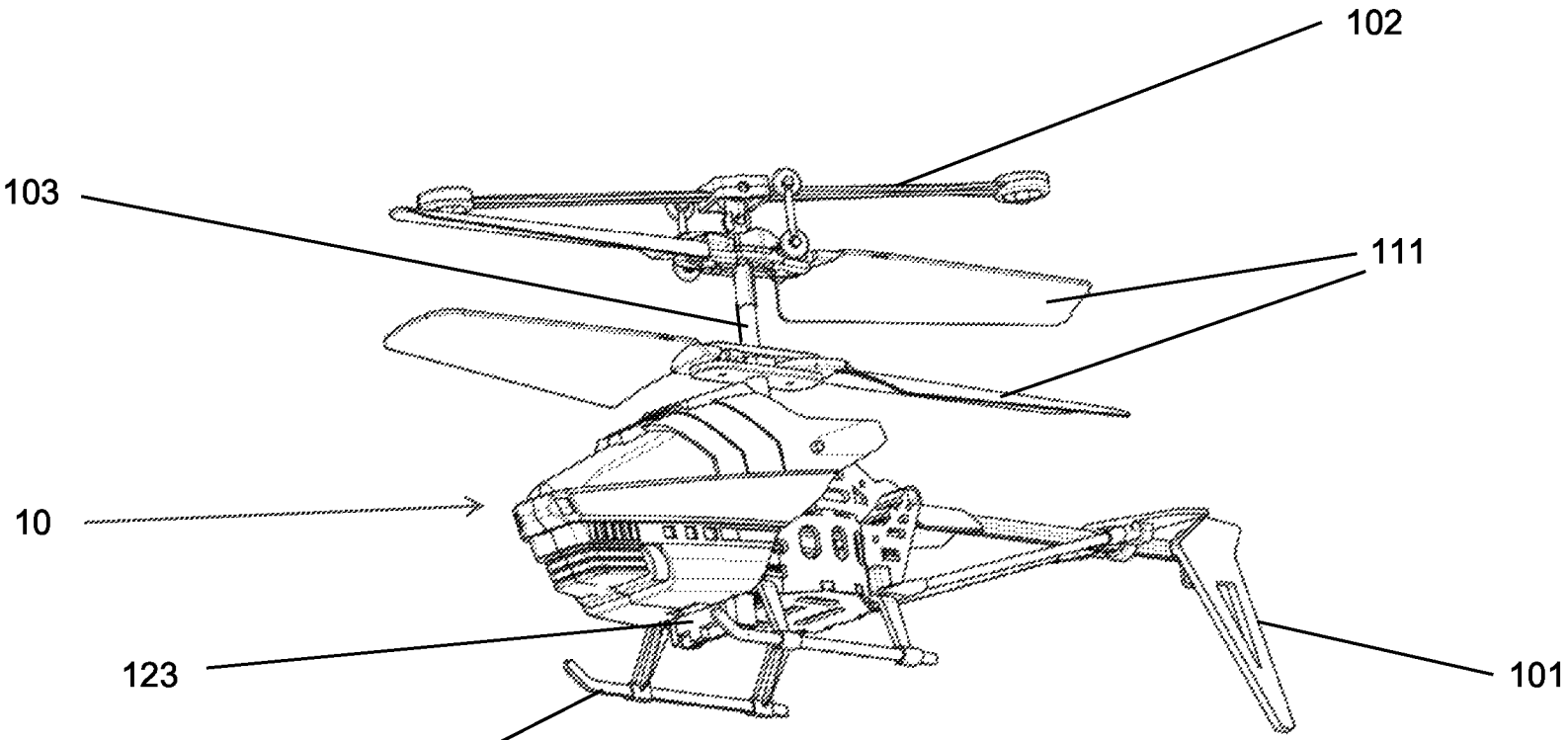
FIG. 3 illustrates a perspective view of an RC helicopter in accordance with an embodiment of the present invention.

As shown in FIGS. 1 to 3, one embodiment of the RC helicopter 10 includes a main body 100 attached to a cockpit cover 104, a tail and tail fins 101, a rotor assembly, and a landing skid assembly 121. Located on the bottom side of the main body 100 is a charge port 123 that connects to a rechargeable battery (not shown). Under the main body 100 is the landing skid assembly 121 with a plurality of landing skids 122.

The rotor assembly comprises of a main shaft 103, a plurality of rotors and rotor blades 111, and a stabilizer bar 102. The main shaft 103 is powered by the rechargeable battery and controlled by a mechanical gear assembly and a main circuit board (not shown). Depending on the requirements of the RC helicopter 10, the mechanical gear assembly and the main circuit board assembly can include a variety of different parts, such as a receiving antenna or a receiver for control signal, an electronic voltage regulator, a motor, and a tail wing controller.

The RC helicopter 10 can be controlled by a remote control 20 equipped with a throttle control stick 202 to control the thrust and speed of the RC helicopter 10 and a directional control stick 203 to control the direction of the RC helicopter 10. Toward the center of the remote control housing 200 is an on/off power switch 201 and a charge plug 204. When the charge plug 204 is coupled with the charge port 123 on the RC helicopter 10, the power source of the remote control 20 can be used to charge the battery powering the RC helicopter 10.

Along two sides of the charge plug 204 are a pair of landing rail grooves 205. The landing rail grooves 205 fit with and are capable of attaching to the landing skids 122 of the RC helicopter 10. Aligning the landing rail grooves 205 with the landing skids 122 also aligns the charge plug 204 with the charge port 123. This makes the alignment process much more straightforward and reduces the chance of misconnecting the RC helicopter 10 to the remote control 20, thereby preventing breakage of the RC helicopter 10 and the remote control 20. An indicator such as an LED light can be used to show that the charge plug 204 is properly connected to the charge port 123.

The landing rail grooves 205 also serve to hold the RC helicopter 10 closer to the remote control 20 when the two are attached. This results in a more stable attachment while reducing the amount of shelf or package space needed to store the RC helicopter 10 and the remote control 20 when not in use.

Figure 4:
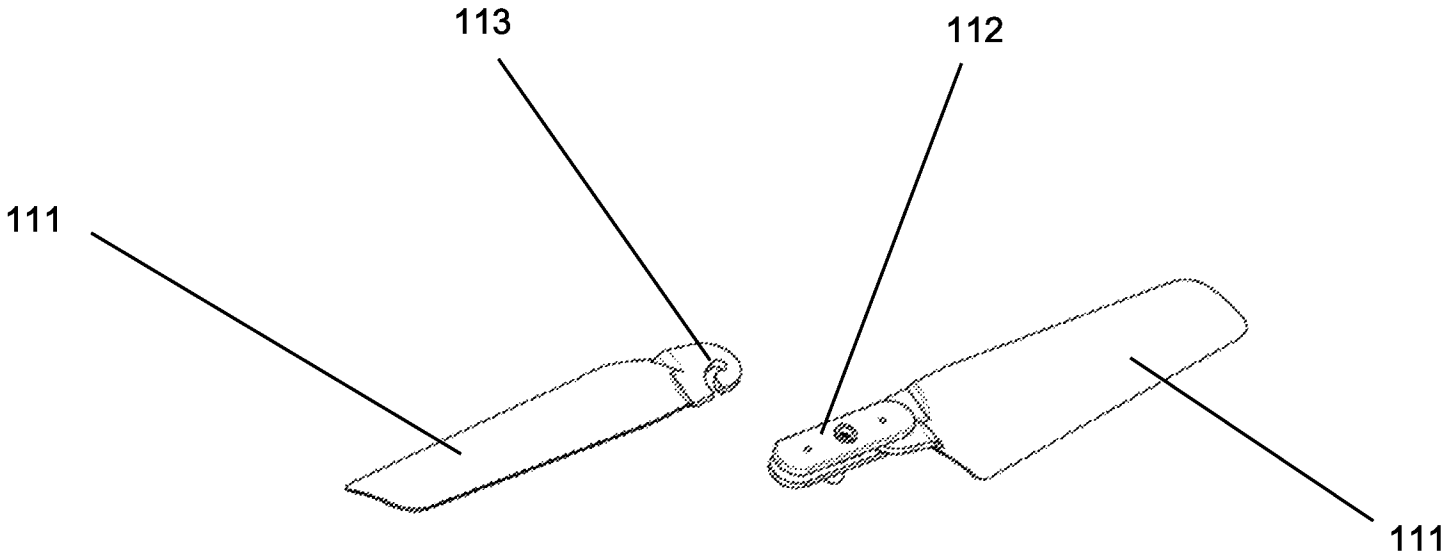
FIG. 4 illustrates a perspective view of a detached rotor and rotor blades of an RC helicopter in accordance with an embodiment of the present invention.

As shown in FIG. 4, the rotor blades 111 can use catch rails 113 instead of screws to attach to a rotor blade grip 112. The catch rails 113 hook onto rods or structures located on the rotor blade grip 112, which attaches to the main shaft 103. Depending on the requirements of the RC helicopter 10, the rotor blades 111 can be fixed to the rotor blade grip 112, or be allowed to pivot about the rods of the rotor blade grip 112, during operation of the RC helicopter.

By using catch rails 113 to secure the rotor blades 111 to the main shaft 103, assembly and disassembly of the rotors and rotor blades 111 become much easier and no tools are necessary to perform the assembly and disassembly. Consequently, manufacturing costs are reduced as no metal is required and less time is needed to assemble the RC helicopter 10. In addition, the rotor blades 111, the rotor blade grip 112, the stabilizer bar 102, and the main shaft 103 can be readily detached to reduce the amount of shelf or package space needed to store the RC helicopter 10.

Figure 5:
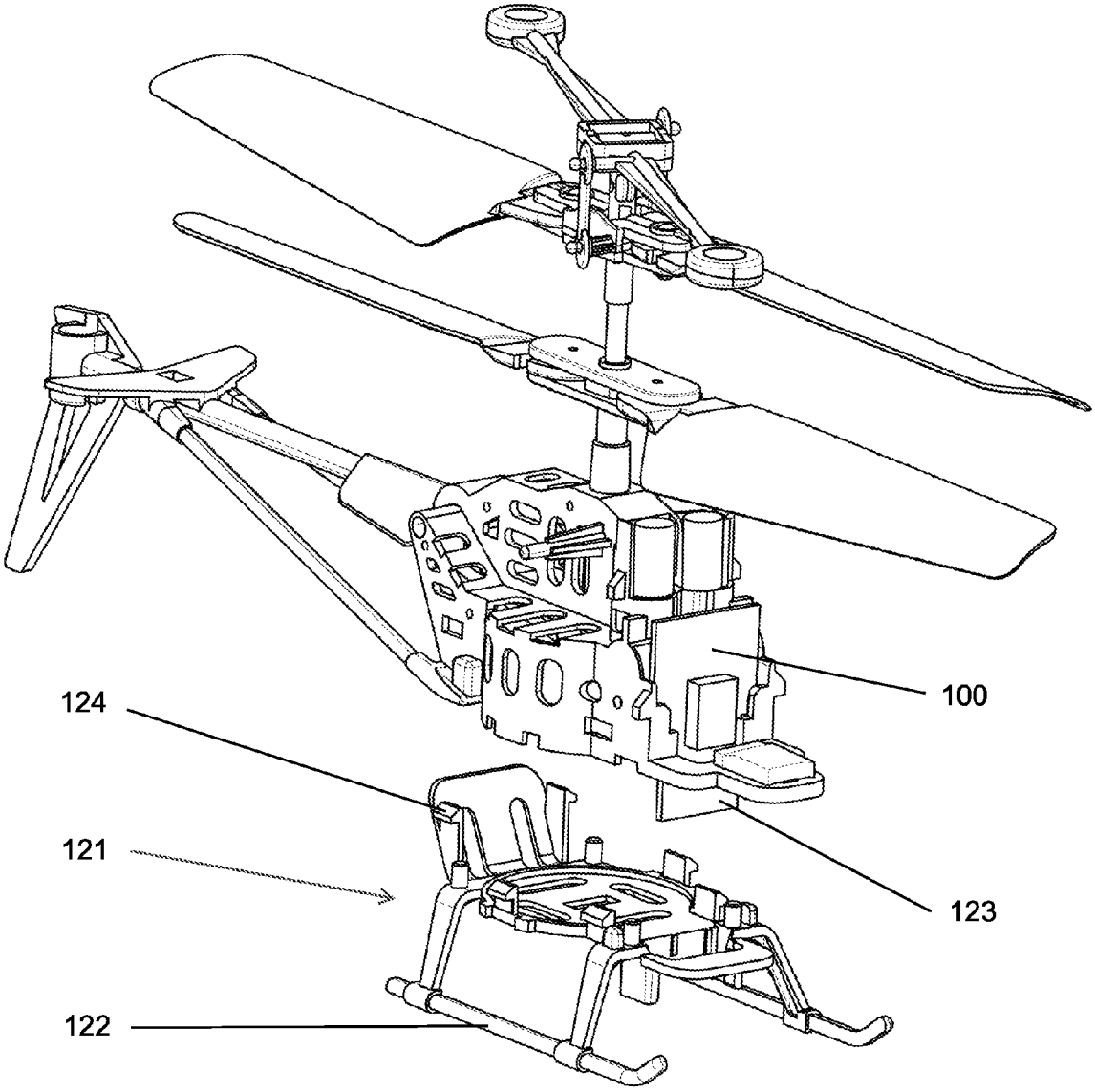
FIG. 5 illustrates a perspective view of a landing skid assembly detached form a main body of an RC helicopter in accordance with an embodiment of the present invention.
Figure 6:
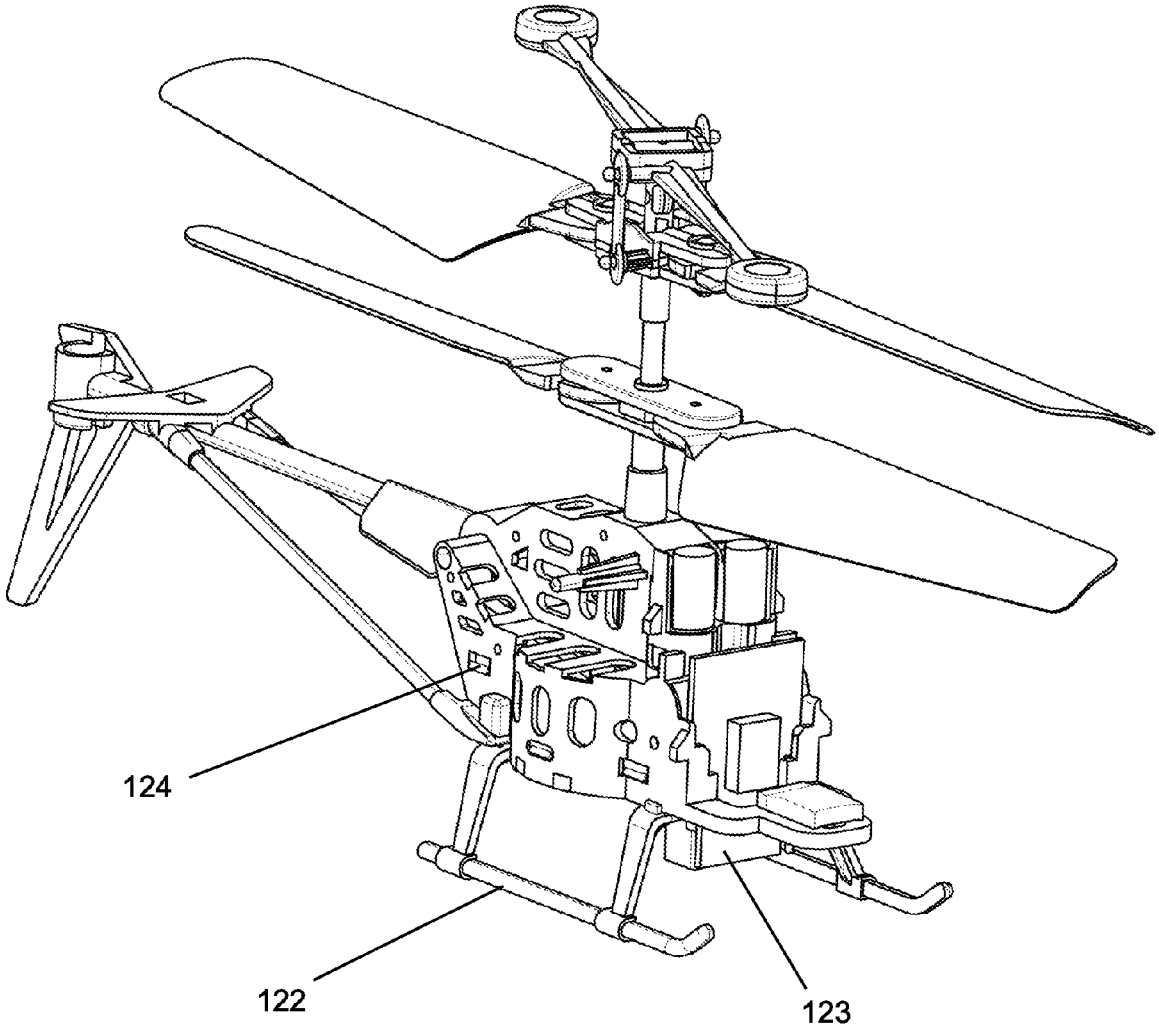
FIG. 6 illustrates a perspective view of a landing skid assembly attached with a main body of an RC helicopter in accordance with an embodiment of the present invention.

FIGS. 5 and 6 show the main body 100 and the landing skid assembly 121 in a detached position and an attached position, respectively. In the attached position, the landing skid assembly 121 helps support the charge port 123 such that the charge plug 204 can be securely connected to the charge port 123.

The landing skid assembly 121 is preferably molded into one piece with a plurality of landing skids 122 and a plurality of clips 124. The main body 100 is also preferably molded into one piece, with holes onto which the clips 124 can engage. No screws are required to attach the main body 100 to the landing skid assembly 121. As previously mentioned, constructing the RC helicopter 10 without screws and in accordance with the invention helps reduces manufacturing costs. Furthermore, this allows the landing skid assembly 121 to be readily detached from the main body 100 to reduce the amount of shelf or package space needed to store the RC helicopter 10.

Figure 7:
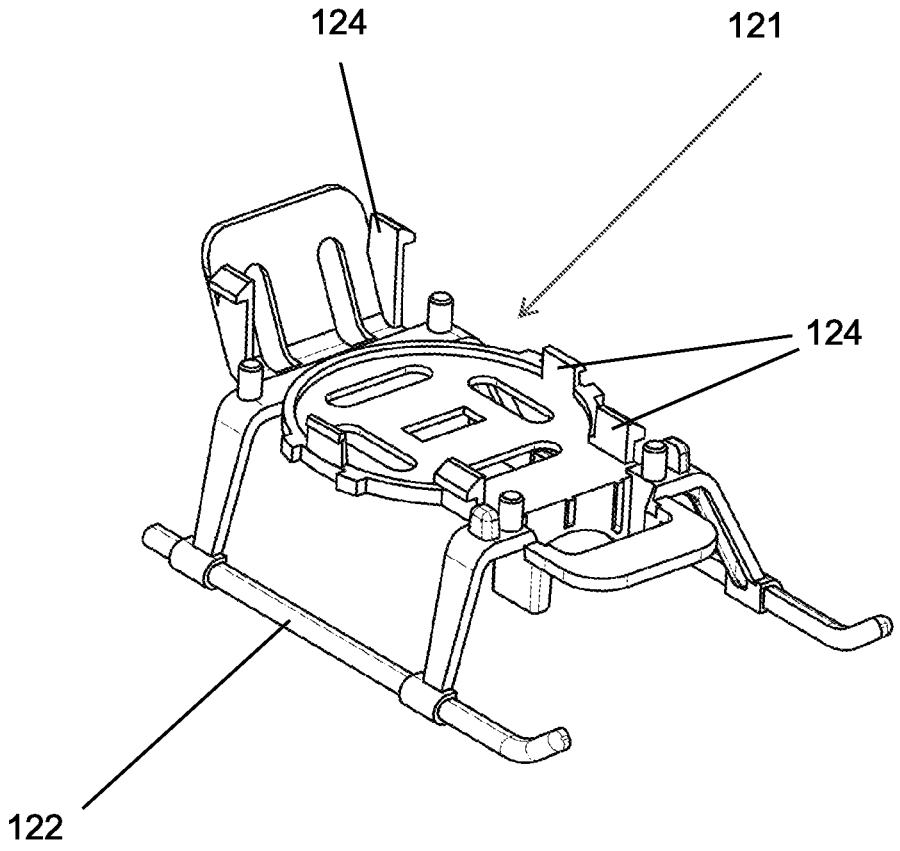
FIG. 7 illustrates a perspective view of a landing skid assembly in accordance with an embodiment of the present invention.
Figure 8:
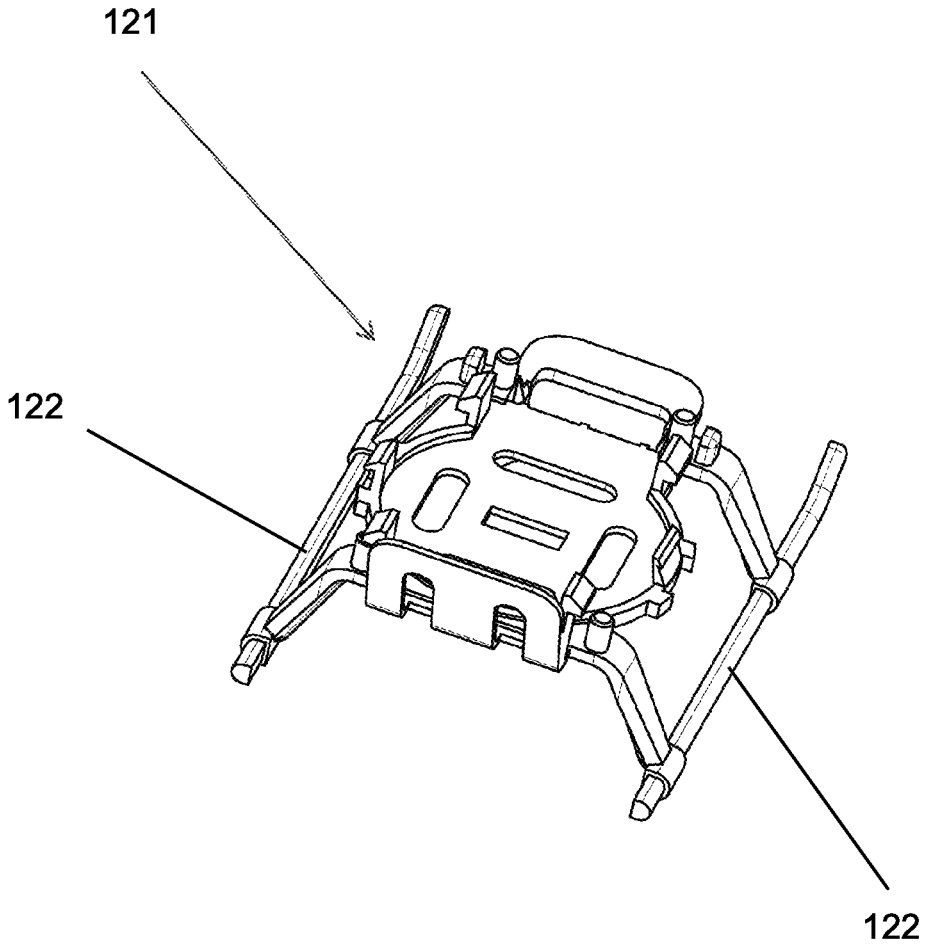
FIG. 8 illustrates a second perspective view of a landing skid assembly in accordance with an embodiment of the present invention.
Figure 9:
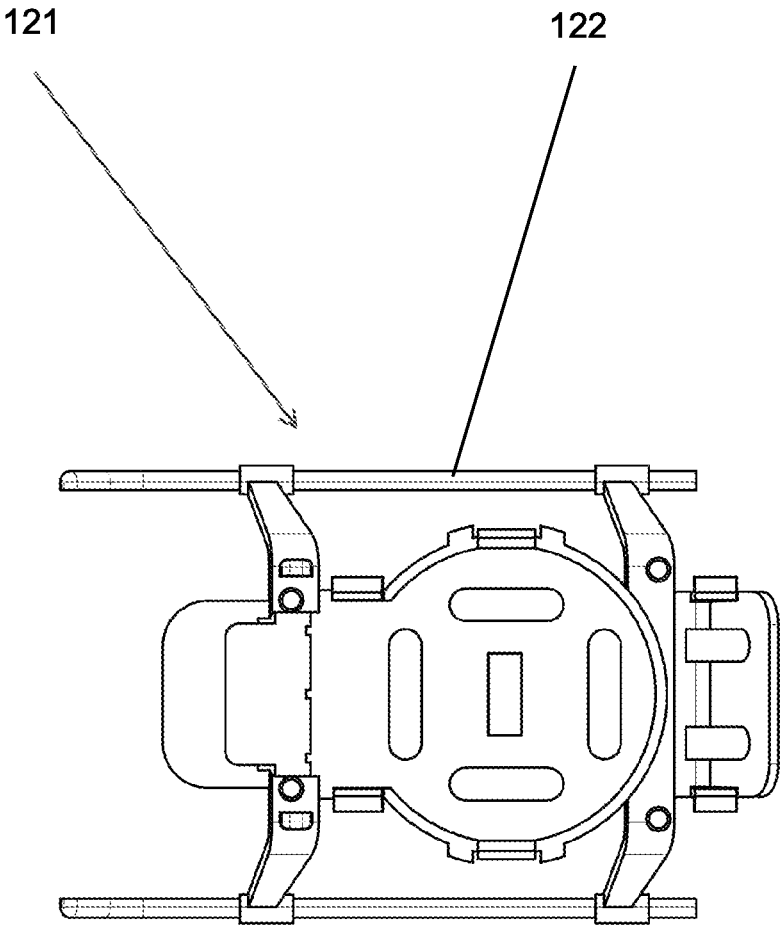
FIG. 9 illustrates a top view of a landing skid assembly in accordance with an embodiment of the present invention.

FIGS. 7 to 9 show the landing skid assembly 121 with the plurality of landing skids 122 and the plurality of clips 124.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims. For example, one skilled in the art will recognize that the different elements of the invention, for example the charge connectors (charge port 123 and charge plug 204), the attachment elements (landing rail groove 205 and landing skids 122), and the clip elements (clips 124 and their corresponding engagement elements), can be placed in alternate positions, for example on the RC helicopter 10, the remote control 20, or vice versa. Similarly, fasteners such as the clip elements and the catch rails 113 are interchangeable with other fasteners.

LIST OF REFERENCE NUMBERS

10 Remote control flying toy helicopter
20 Remote control
100 Main body
101 Tail and tail fins
102 Stabilizer bar
103 Main shaft
104 Cockpit cover
111 Rotor blade
112 Rotor blade grip
113 Catch rail
121 Landing skid assembly
122 Landing skid
123 Charge port
124 Clip
200 Housing
201 Power switch
202 Throttle control stick
203 Directional control stick
204 Charge plug
205 Landing rail groove

The invention claimed is:

1. A toy helicopter with a remote control, comprising:
a power source of the remote control;
a first charge connector on the remote control;
a face of the remote control, the face forming a first landing skid groove and a second landing skid groove;
a main body of the toy helicopter;
at least one rechargeable battery housed by the main body;
a second charge connector on the main body capable of connecting to the first charge connector on the remote control;
a rotor assembly having a main shaft and at least one rotor blade, the rotor assembly connected to the main body;
a landing skid assembly connected to the main body;
a first landing skid of the landing skid assembly, the first landing skid capable of fitting into the first landing skid groove; and
a second landing skid of the landing skid assembly, the second landing skid capable of fitting into the second landing skid groove;
wherein when the toy helicopter and the remote control are in an attached position, the power source is capable of charging the rechargeable battery.

2. The toy helicopter of claim 1, wherein the first landing skid and the second landing skid are on opposite sides of the second charge connector.

3. The toy helicopter of claim 2, further comprising:
a catch rail on the rotor blade capable of engaging with a rotor blade grip of the rotor assembly without use of additional fasteners or tools;
wherein when the catch rail and the rotor blade grip are in an engaged position, the catch rail remains engaged with the rotor blade grip during operation of the toy helicopter.

4. The toy helicopter of claim 3, a plurality of first clip elements on the main body; and a plurality of second clip elements on the landing skid assembly, the landing skid assembly forming a hole through which the second charge connector can pass;

wherein the main body is molded into one piece;

wherein the landing skid assembly is molded into one piece;

wherein the landing skid assembly helps support the second charge connector; and wherein the first clip elements are capable of being attached to the second clip elements without use of additional fasteners or tools.

5. The toy helicopter of claim 3, wherein the catch rail consists of a catch hook and a blade head forming a curved slot with an open end;

wherein the rotor blade grip consists of a grip rod sandwiched by two grip plates, a first grip plate on a top end of the grip rod and a second grip plate on a bottom end of the grip rod;

wherein the grip rod is capable of sliding into the curved slot; and wherein when the grip rod reaches an enclosed end of the curved slot, the catch rail will be secured to the rotor blade grip.

6. The toy helicopter of claim 1, wherein when the first landing skid is not secured onto the first landing skid groove, the first charge connector is prevented from connecting to the second charge connector.

7. The toy helicopter of claim 6, wherein when the first landing skid is engaged with the first landing skid groove and the second landing skid is engaged with the second landing skid groove, the first charge connector is aligned and is in contact with the second charge connector.

8. The toy helicopter of claim 1, wherein the first landing skid can only be secured onto the first landing skid groove when the first charge connector is connected to the second charge connector.

9. The toy helicopter of claim 8, wherein when the first landing skid is engaged with the first landing skid groove and the second landing skid is engaged with the second landing skid groove, a first top peak of the first land skid and a second top peak of the second landing skid are approximately flush with a top side of the remote control.

* * * * *